United States Patent [19]

Alexander

[11] 4,377,620

[45] Mar. 22, 1983

[54] GUT FOR TENNIS RACKET AND THE LIKE AND METHOD OF MAKING SAME

[76] Inventor: Edward Alexander, 3001 Red Hill Ave., Costa Mesa, Calif. 92626

[21] Appl. No.: 390,241

[22] Filed: Jun. 21, 1982

[51] Int. Cl.[3] ..... A63B 51/02; B05D 5/08; D02G 3/36; G10D 3/10

[52] U.S. Cl. ..... 428/372; 57/232; 57/234; 84/297 S; 273/73 R; 273/73 D; 427/180; 428/375; 428/395; 428/401

[58] Field of Search ..... 57/232, 234; 84/297 S; 273/73 R, 73 D; 428/375, 395, 372, 401; 427/180

[56] References Cited

U.S. PATENT DOCUMENTS

| | | | |
|---|---|---|---|
| 2,735,258 | 2/1956 | Crandall | 57/234 |
| 3,180,785 | 4/1965 | Thompson | 428/397 |
| 3,605,399 | 9/1971 | Rijswijk | 57/234 |
| 3,920,658 | 11/1975 | Benson | 428/395 |
| 3,921,979 | 11/1975 | Dischinger | 273/73 R |
| 3,926,431 | 12/1975 | De Lorean | 273/73 D |
| 4,016,714 | 4/1977 | Crandall et al. | 273/73 D |
| 4,084,399 | 4/1978 | Kanemaru et al. | 57/232 |
| 4,238,262 | 12/1980 | Fishel | 156/166 |

FOREIGN PATENT DOCUMENTS

| | | | |
|---|---|---|---|
| 2080124 | 11/1981 | United Kingdom | 273/73 D |

*Primary Examiner*—James C. Cannon

*Attorney, Agent, or Firm*—Harris, Kern, Wallen & Tinsley

[57] ABSTRACT

Improved gut for use on rackets for tennis, badminton, and the like, comprising a gut body and a coating film on the gut body, the film being obtained by drying a liquid formed by dispersing minute particles of ethylene tetrafluoride resin either in a solvent or a molten resin.

10 Claims, 2 Drawing Figures

GUT FOR TENNIS RACKET AND THE LIKE AND METHOD OF MAKING SAME

BACKGROUND OF THE INVENTION

The present invention relates to gut of the type stretched on rackets for use in tennis, badminton, squash, and the like, and to methods for making a gut.

Generally, materials for this sort of gut have been conventionally classified into synthetic resins such as polyamide, etc. and natural materials such as intestines of sheep, whale tissue, etc. In use, the gut, either synthetic or natural, is stretched on a racket. Longitudinal lines are first formed, and then lateral lines are formed at a large tension, so that friction between the longitudinal lines and the lateral ones may readily cause damage to the gut.

One approach in an effort to reduce or eliminate such damage has been to apply paraffin and/or silicone oil to the gut at the time of stretching on the racket. In another approach one of the above-described oils or polyolefin, silicone or nylon, or a wax emulsion is applied to the gut at the time of manufacture of the gut. The purpose of such materials is to prevent damage to the gut at the time of stretching of the gut on rackets and prevent wear of the gut due to frictional heat produced between longitudinal strings and lateral ones during play of each game.

While these additives have been of some initial aid, the effect is soon lessened due to shock at the time of hitting of balls or sticking of sand, dust, and the like to the gut.

Accordingly, an essential object of the present invention is to provide an improved gut which prevents, for a long period of time, damage to the gut at the time of stretching of the gut on a racket and wear of the gut at the time of hitting of balls.

It is known that ethylene tetrafluoride resin is excellent in resistance to static friction and dynamic friction. However, it has not been known how to take advantage of this characteristic in connection with gut for rackets. It is another object of the invention to provide a new gut with ethylene tetrafluoride resin and a method of producing same.

SUMMARY OF THE INVENTION

An improved gut comprising a gut body and a coating film coated around the surface of the gut body, which coating film is formed by dispersing minute particles of ethylene tetrafluoride resin in a solvent or a molten resin. The particles typically are in the order of 0.1 to 10 microns diameter.

DESCRIPTION OF THE PREFERRED EMBODIMENT

Figure 1:
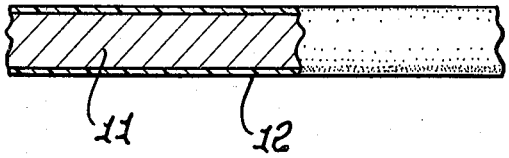
FIG. 1 is a side view, partly in section, of a length of gut incorporating the presently preferred embodiment of the invention.

The gut of FIG. 1 generally includes a gut body 11 made of a synthetic resin such as a polyamide group synthetic fiber, or a natural material such as intestines of sheep, whale tissue, etc. A coating film 12 is formed around the surface of the gut body 11. The coating film is formed by applying a solution of ethylene tetrafluoride resin having a particle diameter of about 0.3 microns dispersed either in a solvent or in molten resin liquid. The film 12 is applied to the surface of the gut body 11 with a spray, or by passing the gut body through the solution, after which the coating film is dried. Typically the thickness of the coating film is in the range of 0.005 to 0.04 mm (5 to 40 microns). For a gut body of 1.3 mm diameter the preferred film thickness is about 0.02 mm (20 microns).

In the process of the present invention, a solution of minute particles of ethylene tetrafluoride resin dispersed either in a solvent or in molten resin solution is applied to the surface of the gut body 11 so as to stick to recess portions of the surface of the gut body 11 to form the coating film 12. The synthetic resin gut typically is formed of a number of winding strings about a core string, providing interstices between the strings. The natural intestine gut has natural grooves or interstices. The solution penetrates the interstices and deposits the minute resin particles, thereby providing a bearing effect for improved wear resistance of the gut.

Typically, the ethylene tetrafluroide resin particles have a diameter in the order of 0.1 to 10 microns, and preferably of about 0.3 micron. The particles may be produced by chopping or grinding or may be purchased in the desired size.

Suitable solvents include 1.1.1 trichloroethylene, tetrachoroethylene, and a resin solution of 40% phenol or meta-para-cresol, 46% ethylene D-chloride, 10% polyamide (nylon), and 4% ethylene tetrafluoride. Alternatively, a molten resin may be used to form the coating film. By way of example, a polyester or polyamide resin is mixed with the ethylene tetrafluoride particles by 3 to 10%, the mixture is melted by heating to 230° to 300° C., and the molten mixture is applied to the gut body.

Particles of larger size, such as a particle diameter of about 20 microns or more, readily fall off the gut and thus cannot provide the desired bearing effect. For example, even if ethylene tetrafluoride resin having a particle diameter of 20 microns or more and dispersed in polyamide resin solution is applied to a gut body of polyamide resin, the amount of the ethylene tetrafluoride resin in the polyamide resin solution is small, and the area of the ethylene tetrafluoride exposed to the surface of the gut body when subjected to wear is small as compared with that of the polyamide resin solution, so that the wear resisting effect of the ethylene tetrafluoride is not obtained.

A frictional cutting test was performed on three designs of gut designated A, B and C. Ten samples of each were tested. Specimen A was prepared by passing a gut body of polyamide resin manufactured by an ordinary method (a 0.16 mm diameter winding string wound doubly around a 0.8 mm diameter core string) through a solution of ethylene tetrafluoride having a particle diameter of about 0.3 microns dispersed, by 5 weight percent, in solvent mainly composed of 1.1.1 trichloroethylene and drying the solution residue sticks to the gut body, producing a coating film about 20 microns thick. Specimen B was a conventional gut as used for Specimen A but subjected to no treatment. Specimen C was prepared by applying ethylene tetrafluoride powder having an ordinary particle diameter of about 20 microns to a conventional gut body as used in Specimens A and B.

TABLE 1

| Specimen | No. of Times for Cutting Longitudinal Line (Range for 10 Tests) | Average No. of Times |
|---|---|---|
| A | 39–47 | 41 |
| B | 1–3 | 2 |
| C | 3–5 | 4 |

Figure 2:
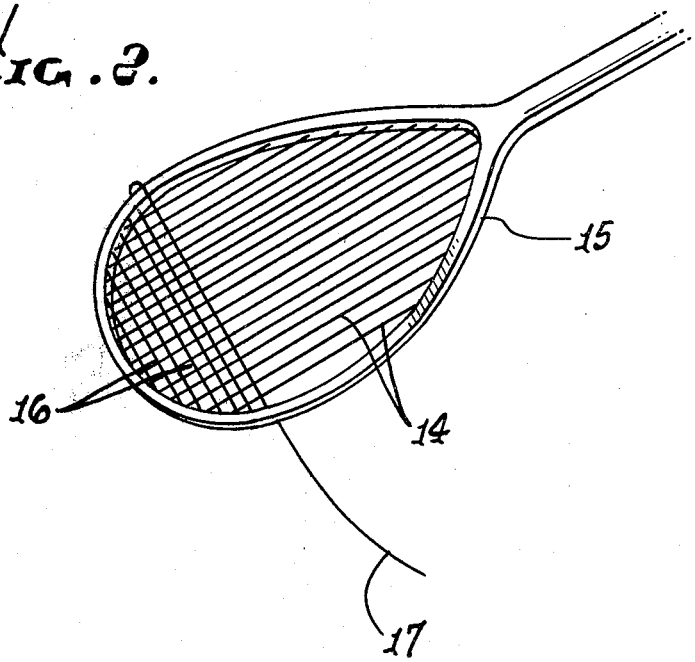
FIG. 2 is a perspective view of a racket illustrating the frictional cutting test of gut described herein below.

The tests were performed as follows, with reference to FIG. 2. Eighteen columns of longitudinal strings 14 were stretched on an ordinary wooden tennis racket 15 at a tension of about 70 pounds. Then seven rows of lateral strings 16 were stretched on the racket 10 from the longitudinal uppermost portion thereof at a tension of 70 pounds. The end 17 of the gut extending out of the racket 10 laterally was free of the 70 pound tension. About 1½ meters of this gut 17 was pulled back and forth manually at a rate of about 3 meters per second, repeatedly until one of the longitudinal strings 14 was cut apart. The number of pulls required to cut a string is reported in Table 1.

This cutting test shows that the gut of the present invention has a wear resistance 10 to 20 times that of the conventional gut.

The gut of the present invention comprises a gut body and a coating film around the surface of the gut body. The coating film is formed by a solution of minute particles of ethylene tetrafluoride dispersed in a suitable solvent or a molten resin liquid. The liquid is dried or cooled to produce the film. The word drying as used herein is intended to include the solidifying of the liquid solution by solvent evaporation and the solidifying of the molten resin by cooling. Damage to the gut due to a large tension at the time of stretching of the gut on rackets is eliminated, wear of the gut produced at points of intersection between longitudinal and lateral strings at the time of hitting of balls is lessened remarkably, and the gut is not subjected to wear due to sticking of sand or dust at the time of playing, for a long period of time.

Although the present invention has been fully described by way of example with reference to the accompanying drawing, it is to be noted that various changes and modifications will be apparent to those skilled in the art. Therefore, unless such changes and modifications otherwise depart from the scope of the present invention, they should be construed as included therein.

I claim:

1. Gut for a tennis racket or the like comprising a gut body and a coating film on the surface of said gut body, said film being a dried liquid containing minute particles of ethylene tetrafluoride resin.

2. Gut as defined in claim 1 wherein said particles are of a diameter in the order of 0.1 to 10 microns.

3. Gut as defined in claim 1 wherein said particles are of a diameter in the order of 0.3 microns.

4. Gut as defined in claim 1 wherein said dried liquid was a solution of said ethylene tetrafluoride particles in a solvent.

5. Gut as defined in claim 1 wherein said dried liquid was a mixture of said ethylene tetrafluoride particles in a molten resin.

6. A method of forming a gut for a tennis racket or the like comprising applying to a gut body a coating film of minute particles of ethylene tetrafluoride resin dispersed in a liquid, and drying the liquid.

7. A method as defined in claim 6 including dispersing the particles in a solvent prior to applying, and permitting the solvent to evaporate after applying.

8. A method as defined in claim 6 including dispersing the particles in a molten resin prior to applying, and permitting the melt to cool and solidify after applying.

9. A method as defined in claim 6 wherein the particles are of a diameter in the order of 0.1 to 10 microns.

10. A method as defined in claim 6 wherein the particles are of a diameter in the order of 0.3 microns.

* * * * *